US011459936B2

(12) United States Patent
Lee

(10) Patent No.: US 11,459,936 B2
(45) Date of Patent: Oct. 4, 2022

(54) ELECTRONIC THERMOSTAT FOR SPLIT COOLING OF AN ENGINE AND AN ENGINE COOLING SYSTEM USING THE SAME

(71) Applicants: HYUNDAI MOTOR COMPANY, Seoul (KR); KIA MOTORS CORPORATION, Seoul (KR)

(72) Inventor: Hyo-Jo Lee, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 125 days.

(21) Appl. No.: 16/657,400

(22) Filed: Oct. 18, 2019

(65) Prior Publication Data

US 2020/0158002 A1 May 21, 2020

(30) Foreign Application Priority Data

Nov. 21, 2018 (KR) ..... 10-2018-0144413

(51) Int. Cl.

| | |
|---|---|
| ***F01P 7/16*** | (2006.01) |
| ***F01P 5/10*** | (2006.01) |
| ***F01P 11/08*** | (2006.01) |
| ***F02M 26/30*** | (2016.01) |

(Continued)

(52) U.S. Cl.

CPC ..... *F01P 7/16* (2013.01); *F01P 3/18* (2013.01); *F01P 5/10* (2013.01); *F01P 11/08* (2013.01); *F02M 26/30* (2016.02); *F01P 2007/146* (2013.01); *F01P 2023/08* (2013.01); *F01P 2025/30* (2013.01); *F01P 2060/04* (2013.01); *F01P 2060/08* (2013.01); *F01P 2070/10* (2013.01)

(58) Field of Classification Search

CPC ..... F01P 7/16; F01P 5/10; F01P 11/08; F01P 3/18; F01P 2070/10; F01P 2023/08; F01P 2025/30; F01P 2060/04; F01P 2060/08; F01P 2007/146; F01P 2060/16; F01P 2070/04; F01P 7/165; F01P 7/167; F01P 2003/027; F02M 26/30

See application file for complete search history.

(56) References Cited

U.S. PATENT DOCUMENTS 4,621,594 A * 11/1986 Kubis ..... F02B 29/0443 123/41.31
7,096,831 B2 * 8/2006 Finkbeiner ..... F02B 29/0493 123/41.1

(Continued)

FOREIGN PATENT DOCUMENTS

KR 101338468 B1 12/2013

*Primary Examiner* — Kurt Philip Liethen

(74) *Attorney, Agent, or Firm* — Lempia Summerfield Katz LLC

(57) ABSTRACT

An electronic thermostat, into which cooling water is flowed from a cylinder head of an engine through a first inlet, controls the flow rate of the received cooling water supplied to outside ambient air exposure. The electronic thermostat includes a first valve for controlling the flow rate of the cooling water supplied to a first passage for connecting a first outlet of the electronic thermostat and a water pump and includes a second valve for controlling the flow rate of the cooling water flowing through a second passage for connecting the outlet of a radiator and a cylinder block of the engine.

20 Claims, 11 Drawing Sheets

(51) Int. Cl.
*F01P 3/18* (2006.01)
*F01P 7/14* (2006.01)

(56) References Cited

U.S. PATENT DOCUMENTS

| | | | | |
|---|---|---|---|---|
| 8,181,610 | B2 * | 5/2012 | Dipaola | F01P 7/16 123/41.1 |
| 2006/0162676 | A1 * | 7/2006 | Pegg | F01P 7/167 123/41.1 |
| 2009/0308335 | A1 * | 12/2009 | Dipaola | F01P 7/165 123/41.1 |
| 2011/0214626 | A1 * | 9/2011 | Watanabe | F01P 7/14 123/41.1 |
| 2016/0031288 | A1 * | 2/2016 | Nishikawa | F01P 3/20 165/43 |
| 2016/0109890 | A1 * | 4/2016 | Styron | F01P 7/16 236/34.5 |
| 2017/0074154 | A1 * | 3/2017 | Kaneko | F01P 7/14 |

* cited by examiner

ELECTRONIC THERMOSTAT FOR SPLIT COOLING OF AN ENGINE AND AN ENGINE COOLING SYSTEM USING THE SAME

CROSS-REFERENCE TO RELATED APPLICATION

This application claims priority to Korean Patent Application No. 10-2018-0144413, filed on Nov. 21, 2018, and which is incorporated herein by reference in its entirety.

BACKGROUND OF THE DISCLOSURE

Field of the Disclosure

The present disclosure relates to an electronic thermostat and an engine cooling system using the same, and more particularly, to an electronic thermostat and an engine cooling system using the same, capable of split cooling and controlling a coolant flow rate of an engine.

Description of Related Art

A thermostat is opened or closed according to a set coolant or cooling water temperature, thereby controlling a bypass flow rate and a radiator flow rate of the coolant circulating inside an engine of a vehicle. In the case of a general mechanical thermostat, as the wax filled in a valve body shrinks by coagulation or expands by melting according to the water temperature of the coolant or cooling water, a valve vertically moves to open or close a passage. In the case of such a mechanical thermostat, the opening and closing are adjusted according to the water temperature of the coolant or cooling water, such that it is impossible to adjust active opening and closing of the passage. In the case of an electronic thermostat for solving such a problem, as disclosed in Korean Patent 10-1338468, it is possible to provide a drive heater capable of heating the wax therein. Thereby, the opening and closing of the passage of the coolant or cooling water is actively adjusted according to the operating condition of the engine and environmental factors.

It is possible to apply the thermostat, thereby controlling the flow rate of the coolant or cooling water so that the water temperature of the coolant or cooling water becomes a low temperature considering the durability of the engine in the high load condition of the engine, and controlling the flow rate of the coolant or cooling water so that the water temperature of the cooling water becomes a high temperature considering the fuel efficiency and the performance improvement in the low load condition thereof.

It is more effective to separately cool a cylinder head and a cylinder block of the engine in order to further improve the fuel efficiency and the engine performance.

The information disclosed in the Background section is only to enhance understanding of the background of the present disclosure. The Background section may therefore contain information that is not previously known to those of ordinary skill in the art to which the present disclosure pertains.

SUMMARY OF THE DISCLOSURE

A cooling system of an engine that uses a conventional thermostat is only able to control the amount of the coolant or cooling water (hereinafter "cooling water") that flows in or out from the head of the engine. Alternatively, as illustrated in FIG. 6, a head thermostat 100*a* and a block thermostat 100*b* for controlling the flow rate of the cooling water in a cylinder head 210 and the flow rate of the cooling water in a cylinder block 220 are provided therein, respectively, in order to achieve the split cooling of the cylinder head 210 and the cylinder block 220 of an engine 200. In this example, there are problems in that, not only the number of parts of the thermostat for separately cooling the cylinder head and the cylinder block of the engine increases, but also the control of the flow rate is complicated because it is necessary to control separate thermostats simultaneously.

The present disclosure is intended to solve the above problems. An object of the present disclosure is to provide an electronic thermostat and a cooling system of an engine using the same, which may control the flow rate of the cooling water in the cylinder head and the cylinder block by using only one electronic thermostat.

The present disclosure for solving the above problem includes an electronic thermostat into which the cooling water is flowed from a cylinder head of an engine through a first inlet. The electronic thermostat is configured for controlling the flow rate of the received cooling water supplied to the outside, i.e., to be exposed to ambient air such as via a radiator. The electronic thermostat includes a first valve for controlling the flow rate of the cooling water supplied to a first passage for connecting a first outlet of the electronic thermostat and a water pump. The electronic thermostat further includes a second valve for controlling the flow rate of the cooling water flowing through a second passage for connecting the outlet side of a radiator and a cylinder block of the engine.

In one embodiment, the first passage is branched at a first branch point from a third passage connected from the outlet side of the radiator to the water pump to be connected to the inlet side of the thermostat.

In one embodiment, the second passage is branched from the third passage at the point under the first branch point to be connected to the inlet side of the cylinder block of the engine.

In one embodiment, the second valve integrally move together according to the movement of the first valve.

The electronic thermostat may further include a third valve for controlling the flow rate of the cooling water supplied to a fourth passage for connecting a second outlet of the electronic thermostat and the inlet side of the radiator.

In one embodiment, the electronic thermostat includes a thermostat case in which the first inlet, the first outlet, and the second outlet are formed. The electronic thermostat may further include a valve body provided inside the thermostat case. The electronic thermostat may also include a thermosensitive member filled inside the valve body. The thermosensitive member may shrink or expand according to a temperature. The first valve may be formed at the first outlet side of the valve body. The third valve may be formed at the second outlet side of the valve body. The second valve may be integrally formed to be spaced at a predetermined interval apart from the first valve at one side of the first valve. The electronic thermostat may further include a drive heater for applying heat to the thermosensitive member in order to drive the first valve, the second valve, and the third valve.

In one embodiment, the first valve, the second valve, and the third valve are operated according to with the temperature of the cooling water. When the temperature of the cooling water is in a first temperature range, the first valve may be opened. At this time, the second valve may be closed and the third valve may be closed.

When the temperature of the cooling water is in a second temperature range higher than the first temperature range, the first valve may be closed. At this time, the second valve may also be closed and the third valve may be opened.

When the temperature of the cooling water is in a third temperature range higher than the second temperature range, the first valve may be closed. At this time, the second valve may be opened and the third valve may be opened.

In one embodiment, the thermostat case is formed with a third outlet connected to the inlet of a low-pressure exhaust gas recirculation (LP EGR) valve or cooler, or to a heater core.

In one embodiment, the thermostat case is formed with a fourth outlet connected to the inlet of a high-pressure exhaust gas recirculation (HP EGR) valve or cooler, or to an oil cooler.

A cooling system of an engine according to the present disclosure for solving the above problems includes the above-described electronic thermostat, an engine, a water pump for supplying the cooling water to the engine, and a control unit for controlling the first valve, the second valve, and the third valve by controlling the drive heater of the electronic thermostat.

The control unit may control the drive heater so that when the temperature of the cooling water is in a first temperature range, the first valve may be opened. At this time, the second valve may be closed and the third valve may be closed.

The control unit may control the drive heater so that when the temperature of the cooling water is in a second temperature range higher than the first temperature range, the first valve may be closed. At this time, the second valve may also be closed and the third valve may be opened.

The control unit may control the drive heater so that when the temperature of the cooling water is in a third temperature range higher than the second temperature range, the first valve may be closed. At this time, the second valve may be opened, and the third valve may be opened.

The control unit may stop the flow of the cooling water in the engine system by stopping an operation of the water pump, when the temperature of the cooling water is lower than the first temperature range.

According to the present disclosure, it is possible to control the temperature of two parts of the cylinder block and the cylinder head by using one electronic thermostat, thereby saving in manufacturing costs and simplifying the layout of the relevant parts in the engine as compared to the conventional technology of using two thermostats.

In addition, it is possible to control the movement of one valve of the electronic thermostat to collectively control the flow rate in three passages of the cooling water simultaneously, thereby simplifying a control of the flow rate of the cooling water.

According to the present disclosure, it is possible to realize the split cooling of two parts of the cylinder block and the cylinder head by using one electronic thermostat, thereby improving the fuel efficiency and the engine performance.

In addition, according to the present disclosure, it is possible to quickly increase the water temperature of the cooling water and the oil in the block by stopping the flow of the cooling water in the block in the cooling condition of the engine, thereby reducing the friction inside the engine.

In addition, it is possible to appropriately control the flow rate of the cooling water in the radiator, the cylinder block, and the cylinder head according to the water temperature of the cooling water according to the revolutions per minute (RPM) of the engine, the engine load, the external air temperature, and the like, thereby improving the fuel efficiency and the durability of the engine.

DESCRIPTION OF SPECIFIC EMBODIMENTS

Hereinafter, various embodiments of the present disclosure are described in detail with reference to the accompanying drawings.

Figure 1:
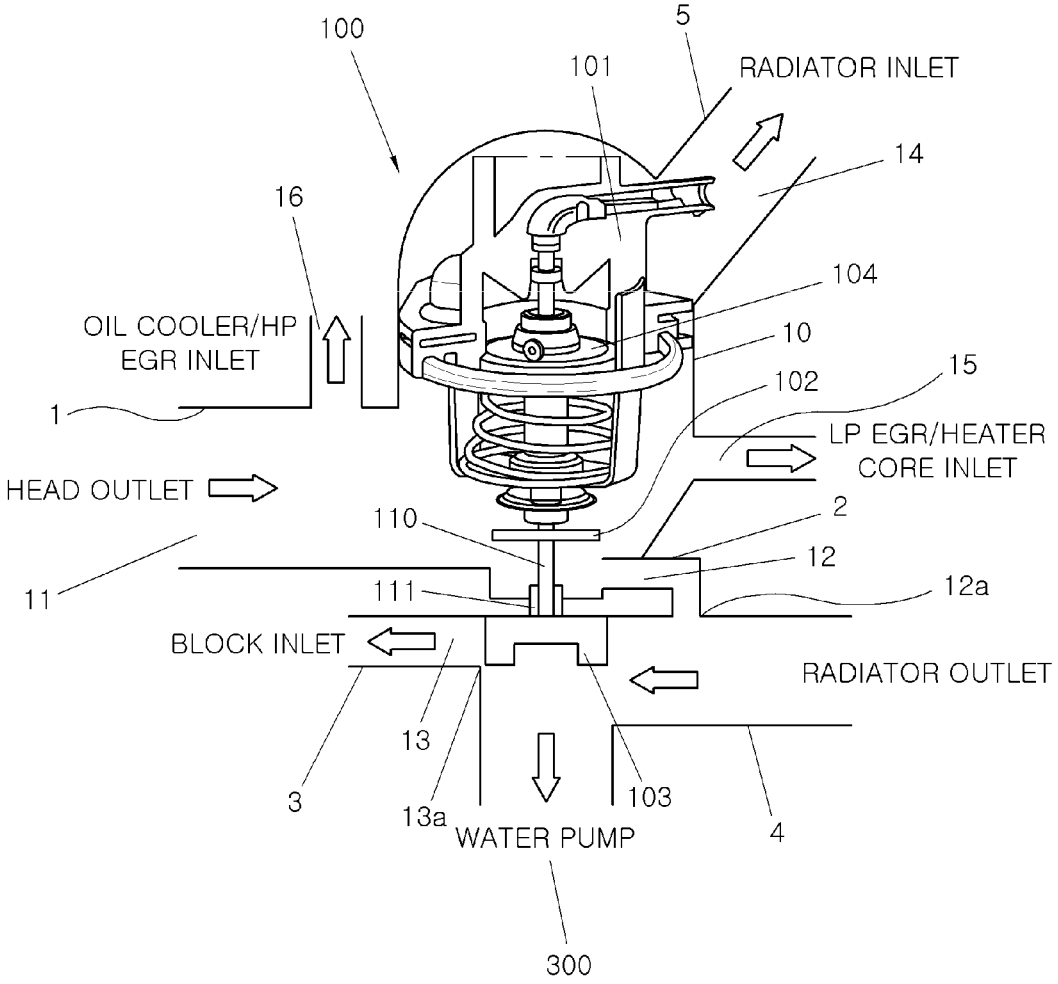
FIG. 1 is a schematic configuration diagram of an electronic thermostat according to an embodiment of the present disclosure.

FIG. 1 is a schematic configuration diagram of an electronic thermostat according to an embodiment of the present disclosure.

Figure 2:
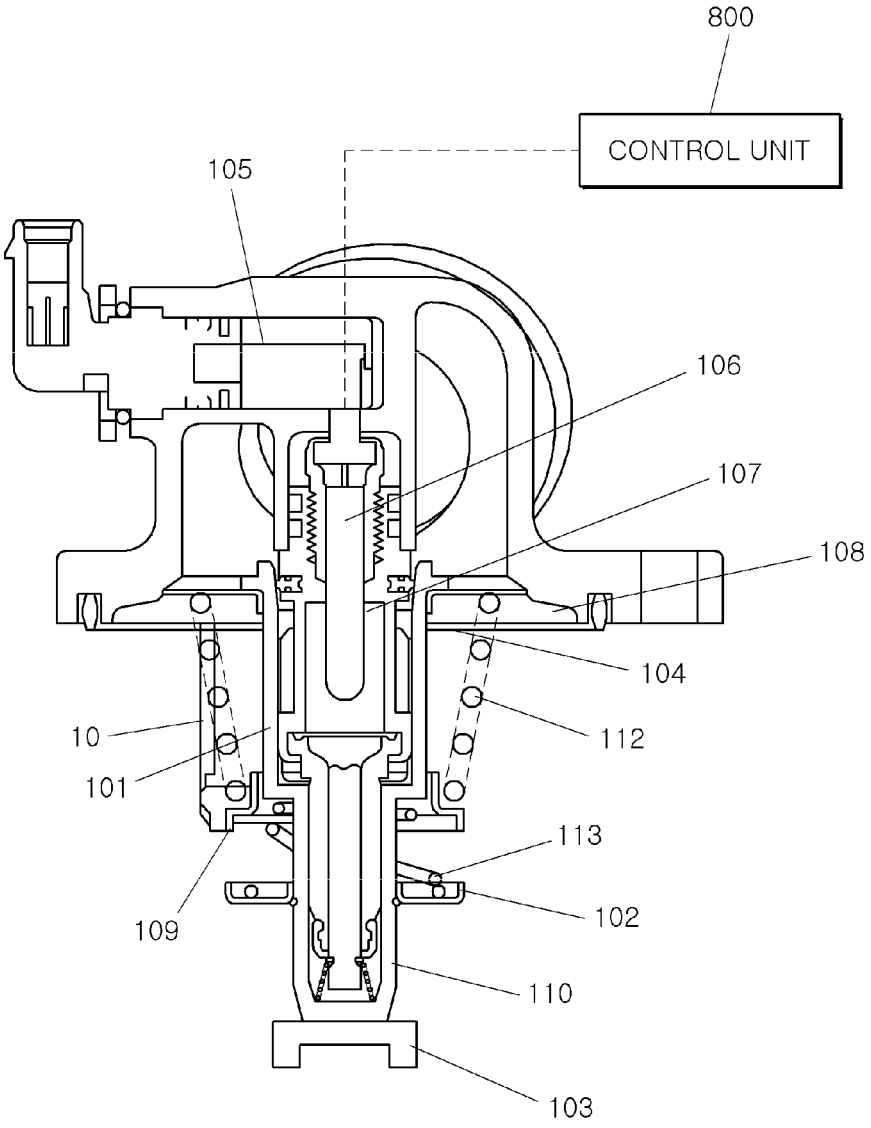
FIG. 2 is a cross-sectional diagram of the inside of the electronic thermostat according to an embodiment of the present disclosure.

As illustrated in FIGS. 1 and 2, an electronic thermostat 100 according to an embodiment of the present disclosure includes a thermostat case 10. The thermostat case 10 includes a first inlet 11 connected to a cooling water inflow passage 1 for connecting between a cylinder head 210 (shown in FIG. 4A) and the electronic thermostat 100. The thermostat case 10 further includes a first outlet 12 connected to a first passage 2 for connecting the electronic thermostat 100 and a water pump 300. The thermostat case 10 also includes a second outlet 14 connected to a fourth passage 5 for connecting the inlet side of a radiator 400 and the electronic thermostat 100. In other words, the cooling water flowed from the cylinder head 210 of the engine into the electronic thermostat 100 through the first inlet 1 is flowed out to the water pump 300 and the radiator 400 through the first outlet 12 and the second outlet 14, respectively.

When viewed from the side surface thereof, a third passage 4, which allows the cooling water cooled by the radiator 400 to flow from the outlet side of the radiator 400 toward the water pump 300, is installed on the lower portion of the electronic thermostat 100. Then, the first passage 2 extended from the first outlet 12 of the electronic thermostat 100 joins with a third passage 4 at a first branch point 12*a* of the third passage 4. Therefore, the cooling water flowed out from the first outlet 12 joins at the first branch point 12*a* to go toward the water pump 300 together with the cooling water flowed out from the outlet of the radiator 400.

At a second branch point 13*a* under the first branch point 12*a* of the third passage 4, the third passage 4 is branched and the branched passage forms a second passage 3 connected to the inlet side of a cylinder block 220 so that a part of the cooling water flowing to the water pump 300 goes toward the cylinder block 220 through the third passage 4.

The electronic thermostat 100 includes a first valve 102 and a third valve 104, respectively, in order to adjust the flow rate of the cooling water flowed out to the water pump 300 through the first outlet 12 and the flow rate of the cooling water flowed out to the radiator 400 through the second outlet 14. As described below, the first valve 102 is installed at the lower end of a valve body 101, and the third valve 104 is installed at the upper end of the valve body 101. Accordingly, the first valve 102 and the third valve 104 adjusts the opening and closing of the first outlet 12 and the second outlet 14 by straightly moving vertically and integrally according to the shrinkage and the expansion of a thermosensitive member 107 filled in the valve body 101.

The electronic thermostat 100 according to the present disclosure further includes a second valve 103 for adjusting the flow of the cooling water to the cylinder block 220. As illustrated in FIG. 1, when viewed from the side surface thereof, the second valve 103 is integrally formed at one end of a shaft 110 extended toward the lower portion of the first valve 102. More specifically, the shaft 110 integrally formed with the first valve 102 extends downwardly to pass through the bottom of the thermostat case 10. A bearing 111 is installed on the inner circumferential surface of a through hole of the thermostat case 10 through which the shaft 110 passes so that the shaft 110 may support the axis thereof when moving vertically. The second valve 103 is integrally installed at the lower end of the shaft 110. Accordingly, when the first valve 102 moves vertically, the second valve 103 also moves vertically in interlock therewith.

As illustrated in FIG. 1, the second valve 103 opens and closes an inlet 13 to which the third passage 4 and the second passage 3 are connected at the second branch point 13*a* of the third passage 4. As illustrated in FIG. 1, when the second valve 103 is at the top dead center, that is, when the thermosensitive member 107 filled in the valve body 101 has shrunk, the inlet 13 is closed by the second valve 103. Then, when the thermosensitive member 107 is expanded by the increase in the water temperature of the cooling water or the heating of the drive heater 106, it is configured so that the inlet 13 is opened as the first valve 102 is descended and the second valve 103 is also descended in interlock therewith.

The thermostat case 10 may have a third outlet 15 through which the cooling water flows to an LP EGR or a heater core, and a fourth outlet 16 through which the cooling water is flowed out to a HP EGR or an oil cooler.

FIG. 2 is a cross-sectional diagram illustrating the inside of the thermostat case 10 of the electronic thermostat 100 according to an embodiment of the present disclosure.

A valve body 101 is mounted inside the thermostat case 10 of the electronic thermostat 100. A wax 107 is filled in the valve body 101 as a thermosensitive member. A drive heater 106 is provided therein to heat the wax 107 by using a current supplied from a connector 105. The drive heater 106 is connected to a control unit 800 through Controller Area Network (CAN) communication or the like. The drive heater 106 heats the wax 107 at a predetermined temperature according to a control duty signal of the control unit 800. The wax 107 shrinks by coagulation or expands by melting according to the water temperature of the cooling water or the heating of the drive heater 106. Thereby, the valve body 101 moves vertically.

Then, the third valve 104, which selectively blocks the second outlet 14 through which the cooling water flows to the radiator 400, is integrally formed on the upper end portion of the valve body 101. A first valve spring 112 is disposed inside the thermostat case 10. The upper end portion of the first valve spring 112 elastically supports the lower end portion of the third valve 104 upwardly. The lower end portion of the first valve spring 112 is supported by a lower frame 109 of the thermostat case 10. When the temperature of the cooling water is low and the wax 107 is not heated by the drive heater 106, the wax 107 does not expand. Therefore, the third valve 104 is pressurized on an upper frame 108, which is a valve seat, by the elastic force of the first valve spring 112 to close the second outlet 14 formed in the upper frame 108. Then, when the temperature of the cooling water flowed into the electronic thermostat 100 is high or the wax 107 is heated by the drive heater 106, the wax 107 begins to expand to move in the direction spaced apart from the upper frame 108 to open the second outlet 14 formed on the upper frame 108.

Then, the first valve 102, which selectively blocks the first outlet 12 through which the cooling water flows to the water pump 300, is integrally formed on the lower end portion of the valve body 101. A second valve spring 113 is provided thereon, and the upper end portion of the second valve spring 113 is supported by the lower frame of the thermostat case 10. The lower end portion of the second valve spring 113 is supported by the upper surface of the first valve 102. Therefore, when the temperature of the cooling water is low and the wax 107 is not heated by the drive heater 106, the first outlet 12 is kept open. When the temperature of the cooling water flowed into the electronic thermostat 100 is high or the wax 107 is heated by the drive heater 106, the first valve 102 moves downwardly together with the third valve 104 to close the first outlet 12.

The second valve 103 is integrally formed on the lower portion of the first valve 102 to be spaced at a predetermined interval apart from the first valve 102. A shaft 110 is integrally extended downwardly from the lower surface of the first valve 102. The second valve 103 is integrally connected to the lower end of the extended shaft 110 to integrally form the first valve 102 and the second valve 103. Therefore, when the first valve 102 moves upwardly or downwardly by the shrinkage or the expansion of the wax 107, the second valve 103 also moves upwardly or downwardly together therewith to open or close the inlet 13 of the second passage 3 going toward the cylinder block 220, as described above.

Figure 3A:
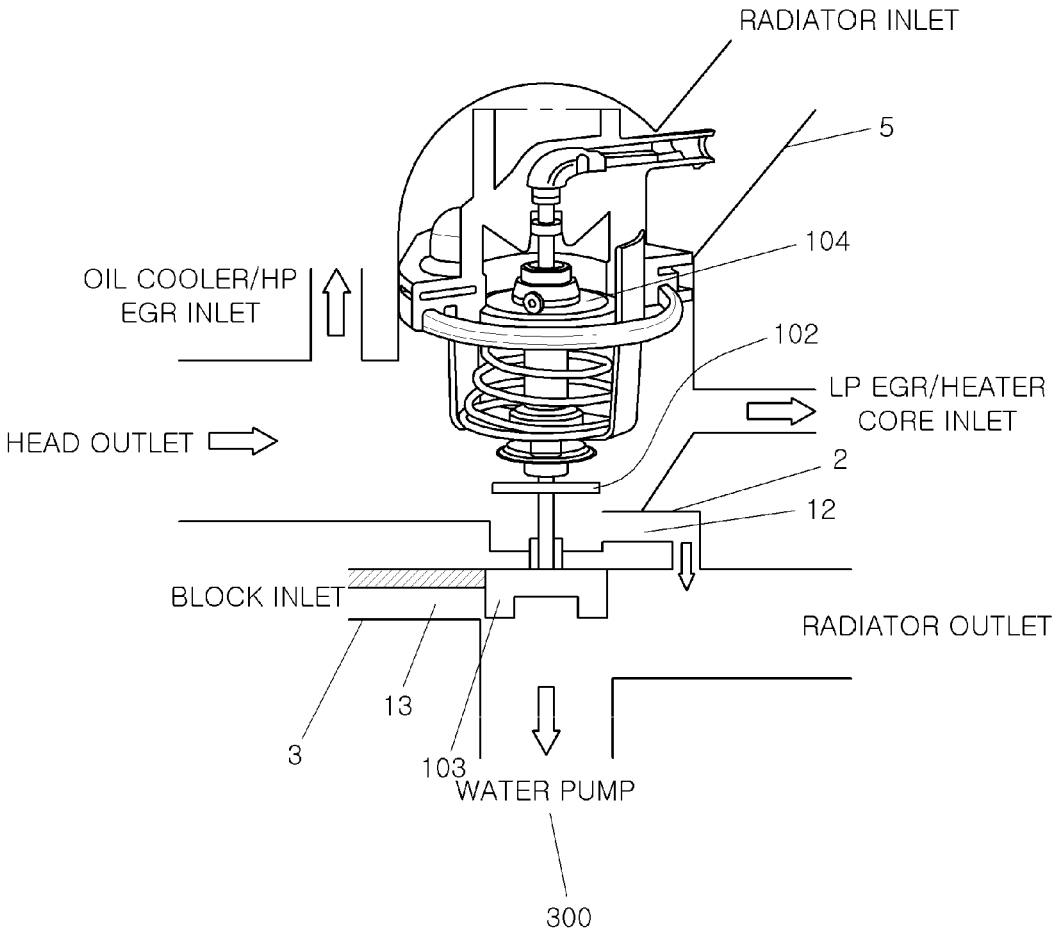
FIGS. 3A-3C are diagrams for explaining an operation of the electronic thermostat of the present disclosure according to the water temperature of the cooling water.
Figure 3B:
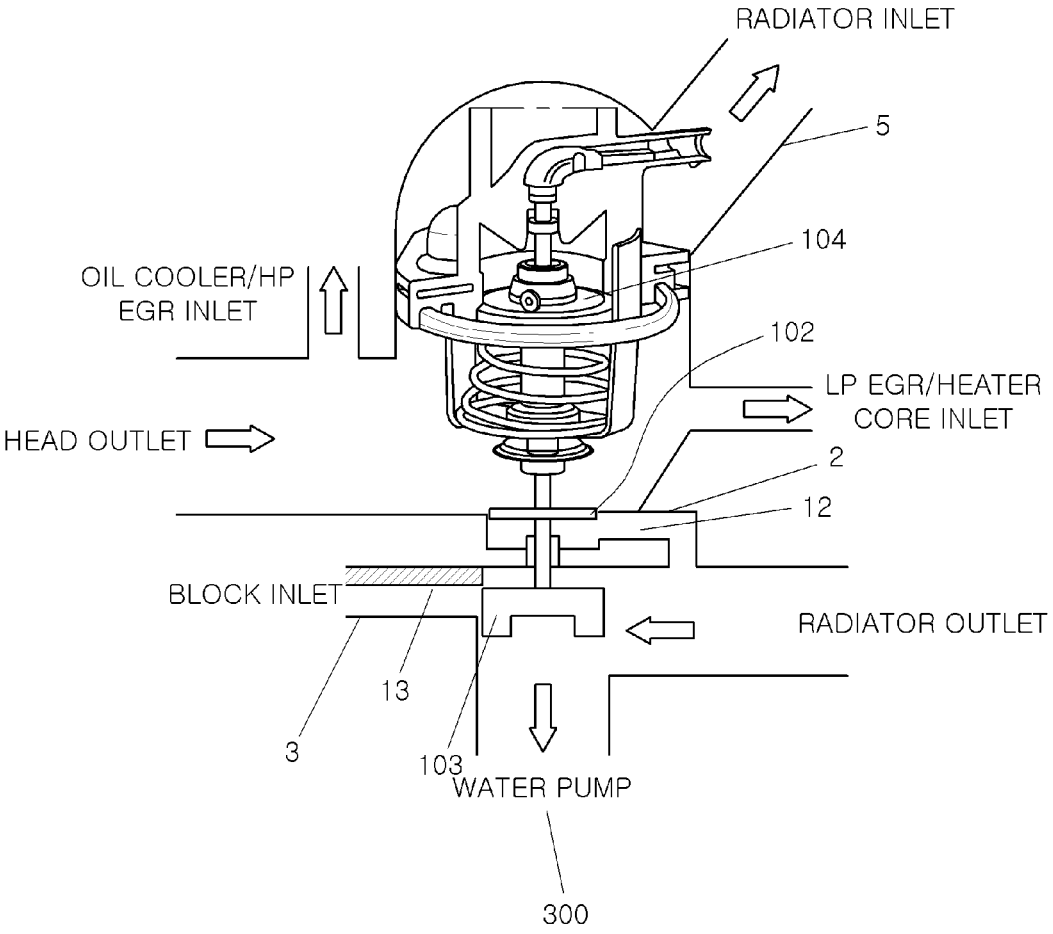
Figure 3C:
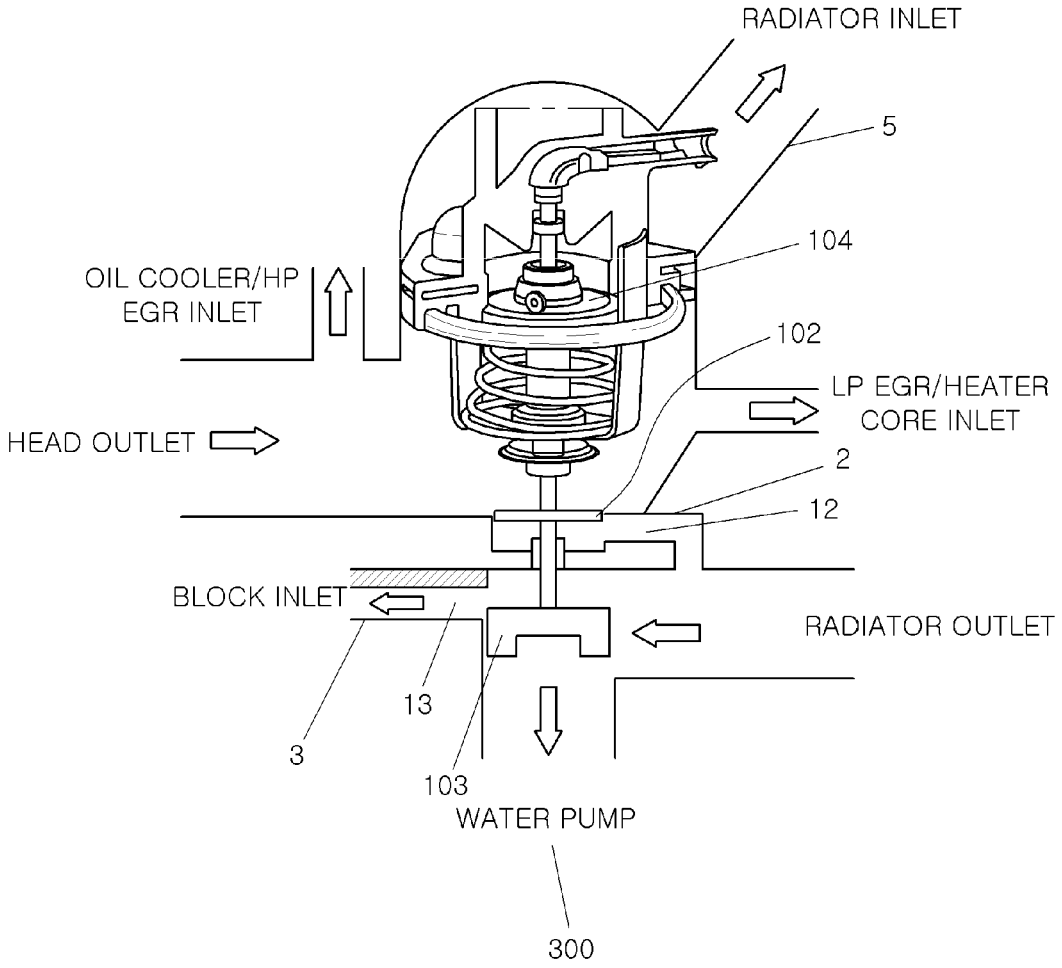

FIGS. 3A-3C are diagrams for explaining an operation of the electronic thermostat according to the present disclosure according to the water temperature of the cooling water.

FIG. 3A is a diagram illustrating an operating state of the electronic thermostat 100 in the state where an engine is in a cold condition and the drive heater 106 is not driven by the control unit 800.

In the example illustrated in FIG. 3A, since the water temperature of the cooling water is low, the wax 107 has been shrunk, such that the valve body 101 is disposed at the top dead center. Therefore, the first valve 102, the second valve 103, and the third valve 104 are all disposed at the top dead center, such that the fourth passage 5 toward the inlet of the radiator 400 is closed by the third valve 104, the first passage 2 toward the water pump 300 is opened by the first valve 102, and the second passage 3 toward the cylinder block 220 is closed by the second valve 103. In other words, the second passage 3 and the fourth passage 5 are closed, and the first passage 2 is opened.

An example illustrated in FIG. 3B is a diagram showing the operating state of the electronic thermostat 100 where the water temperature of the cooling water slightly increases, or the wax is partially heated by the drive heater 106 as compared with FIG. 3A.

The valve body 101 is descended as the wax 107 starts to expand by the increase in the water temperature of the cooling water, and the like. Thereby, the first valve 102, the second valve 103, and the third valve 104 are all slightly descended from the top dead center. At this time, the third valve 104 is spaced apart from the upper frame 108 to open the fourth passage 5, and the first outlet 12 of the first passage 2 is closed by the descended first valve 102. The second valve 103 descends downwardly together with the first valve 102, but the upside side wall of the second passage 3 still contacts with the main body of the second valve 103, such that the inlet 13 of the second passage 3 is closed. In other words, the first passage 2 and the second passage 3 are closed, and the fourth passage 5 is opened.

An example illustrated in FIG. 3C is a diagram illustrating the operating state of the electronic thermostat 100 in which the water temperature of the cooling water further increases, or the wax is further heated by the drive heater 106 than in FIG. 3B.

In this state, as in the state illustrated in FIG. 3B, the fourth passage 5 is opened by the third valve 104, and the first passage 2 is closed by the first valve 102.

However, since the second valve 103 has been further descended than in the state illustrated in FIG. 3B, the upside side wall of the second passage 3 and the second valve 103 are spaced apart from each other to open the inlet 13 of the second passage 3. The third valve 104 is spaced apart from the upper frame 108 to open the fourth passage 5. In other words, the first passage 2 is closed, and the second passage 3 and the fourth passage 5 are opened.

As described above, in the case of using the electronic thermostat 100 according to the present disclosure, it is possible to control one thermostat. As a result, it is possible to control the flow rate of the cooling water of three parts simultaneously, and in particular, it is possible to control the flow rate of the cooling water from the cylinder head 210 and the flow rate of the cooling water to the cylinder block 220, respectively. Thereby, the split cooling is achieved.

Figure 5:
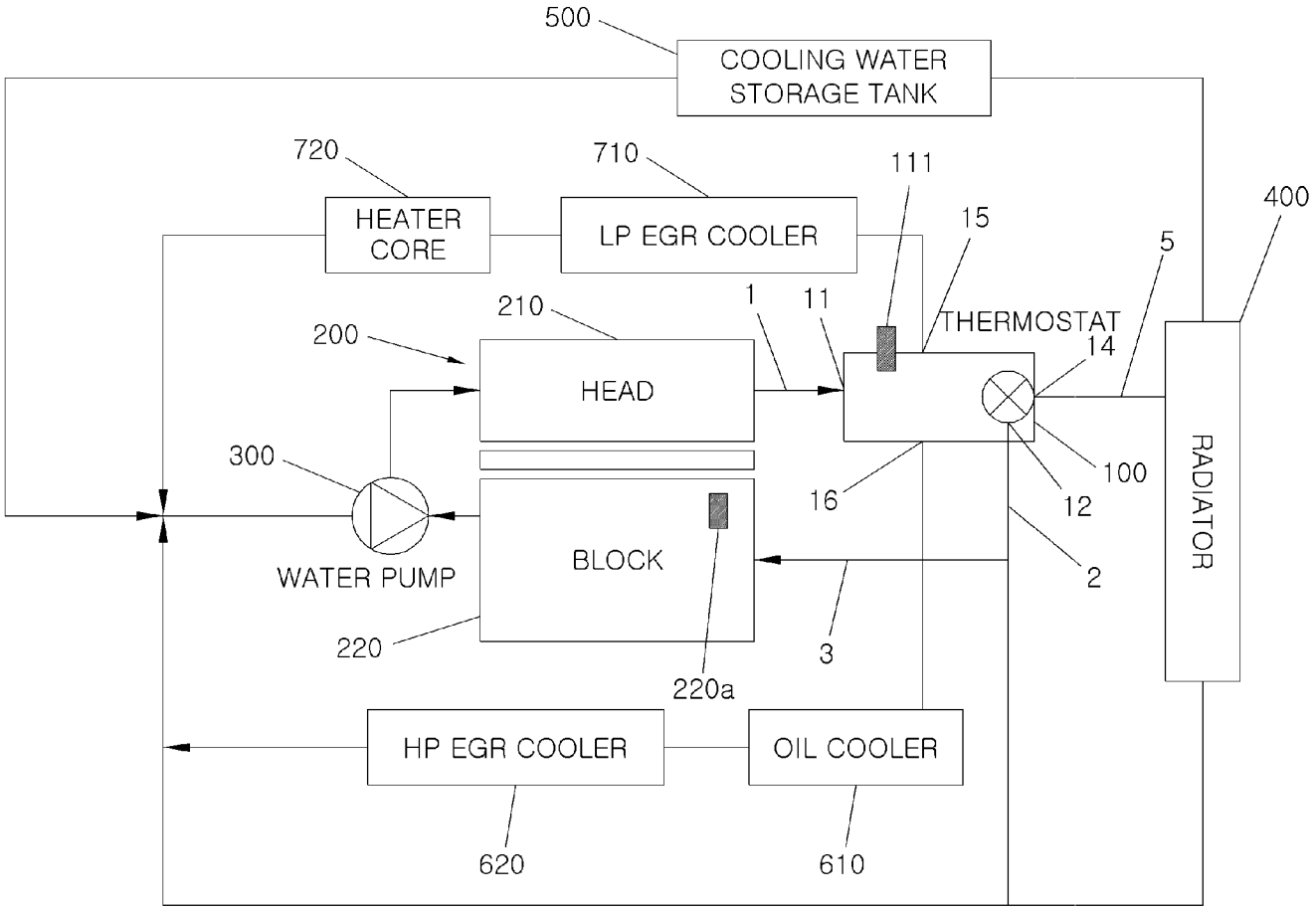
FIG. 5 is a diagram illustrating the engine cooling system using the electronic thermostat according to an embodiment of the present disclosure.
Figure 6:
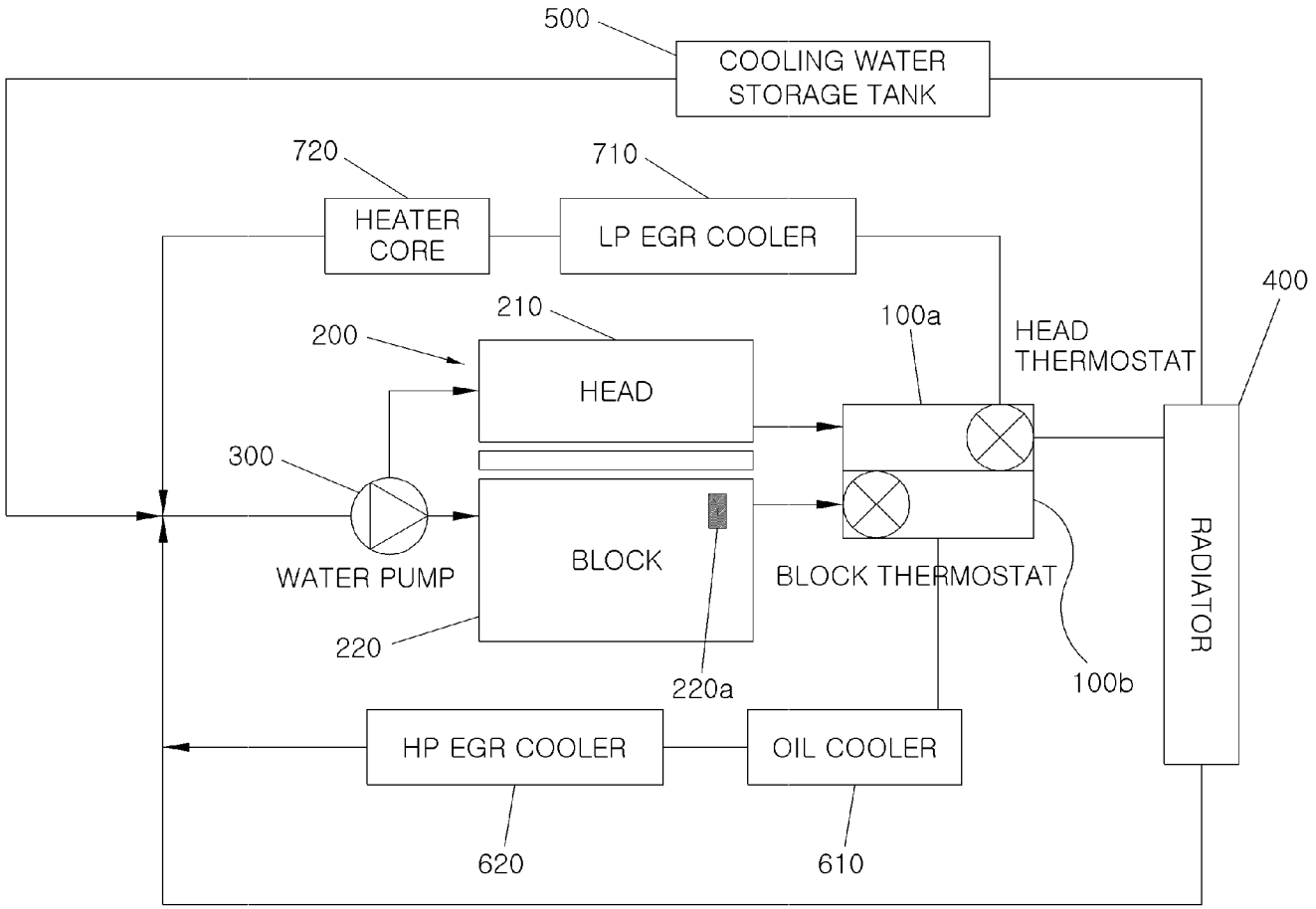
FIG. 6 is a diagram illustrating the engine cooling system using the conventional electronic thermostat.

FIG. 5 is a diagram illustrating an engine cooling system using the electronic thermostat according to an embodiment of the present disclosure.

As illustrated in FIG. 5, an engine cooling system according to an embodiment of the present disclosure includes an engine 200 composed of a cylinder head 210 and a cylinder block 220, the electronic thermostat 100 illustrated in FIG. 1, and the control unit 800 illustrated in FIG. 2 for controlling the electronic thermostat 100.

In this embodiment, the cooling of the engine system, which includes the engine 200, the water pump 300, the radiator 400, a cooling water storage tank 500, an oil cooler 610, a HP EGR cooler 620, an LP EGR cooler 710, and a heater core 720, is performed by the engine cooling system.

The cooling water stored by the cooling water storage tank 500 is pumped by the water pump 300 to flow into the cylinder block 220 of the engine 200 to cool the engine. The cooling water having cooled the engine 200 flows to the cooling water inflow passage 1 and is supplied to the electronic thermostat 100 through the first inlet 11 of the electronic thermostat 100.

The cooling water supplied to the electronic thermostat 100 is selectively supplied to the radiator 400, the water pump 300, and the cylinder block 220 according to the drive condition of the engine and the water temperature of the cooling water. Then, a part of the received cooling water is supplied to the LP EGR cooler 710 or the heater core 720 through the third outlet 15. A part of the cooling water is also supplied to the HP EGR cooler 620 or the oil cooler 610 through the fourth outlet 16. Although the example illustrated in FIG. 5 shows that the cooling water is always supplied to the HP EGR cooler 620 or the like, the present disclosure is not limited to the above-described embodiment. It is also possible to separately control the amount of the supplied cooling water for the corresponding parts by providing a separate flow rate control valve.

In this example, the oil cooler 610 cools the oil or heats the oil by the supplied cooling water, and the heater core 720 heats the indoor air of the vehicle by the supplied cooling water. Then, the radiator 400 radiates the heat of the high-temperature cooling water to the outside, i.e., the ambient air in contact with the radiator. Then, the LP EGR cooler 710 and the HP EGR cooler 620 cool the LP EGR gas and the HP EGR gas before being supplied to the intake system of the engine 200, respectively.

FIGS. 4A to 4D are diagrams explaining the flow of the cooling water in the engine cooling system of the present disclosure according to the water temperature of the cooling water. In the drawings, the portion indicated by the bold line illustrates the portion where the cooling water flows.

Figure 4A:
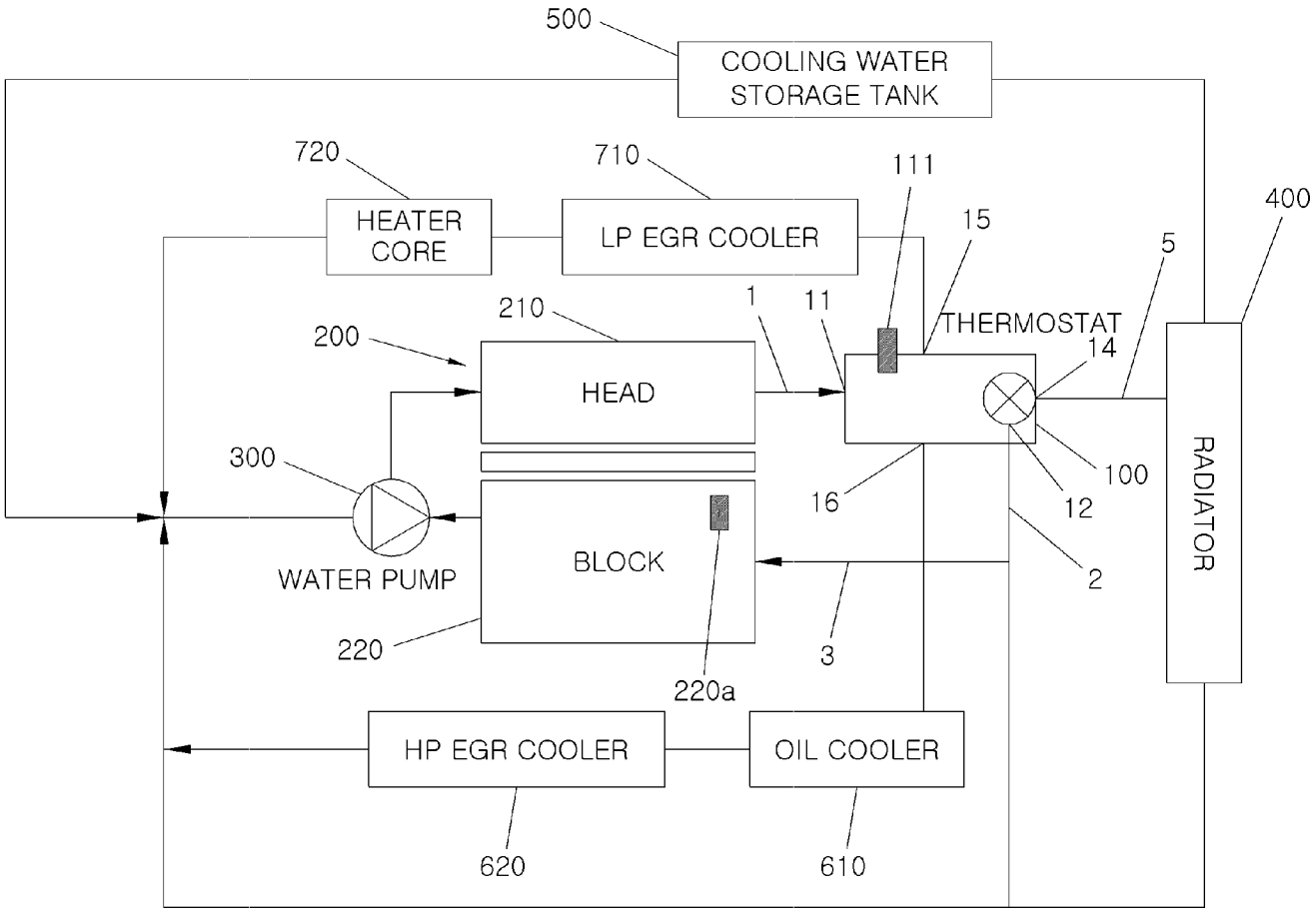
FIGS. 4A-4D are diagrams for explaining the flow of the cooling water in an engine cooling system of the present disclosure according to the water temperature of the cooling water.

FIG. 4A is a diagram illustrating the flow of the cooling water when the operating condition of the engine 200 is a cold condition. When the temperature of the cooling water is in a cold state of the engine (e.g., about 50° C. or less) lower than a first temperature range, it is necessary to increase the temperature of the cooling water as quickly as possible by stopping the flow of the cooling water for rapid warm-up. Therefore, the control unit 800 stops the operation of the water pump 300 to stop the flow of the cooling water inside the engine system.

Figure 4B:
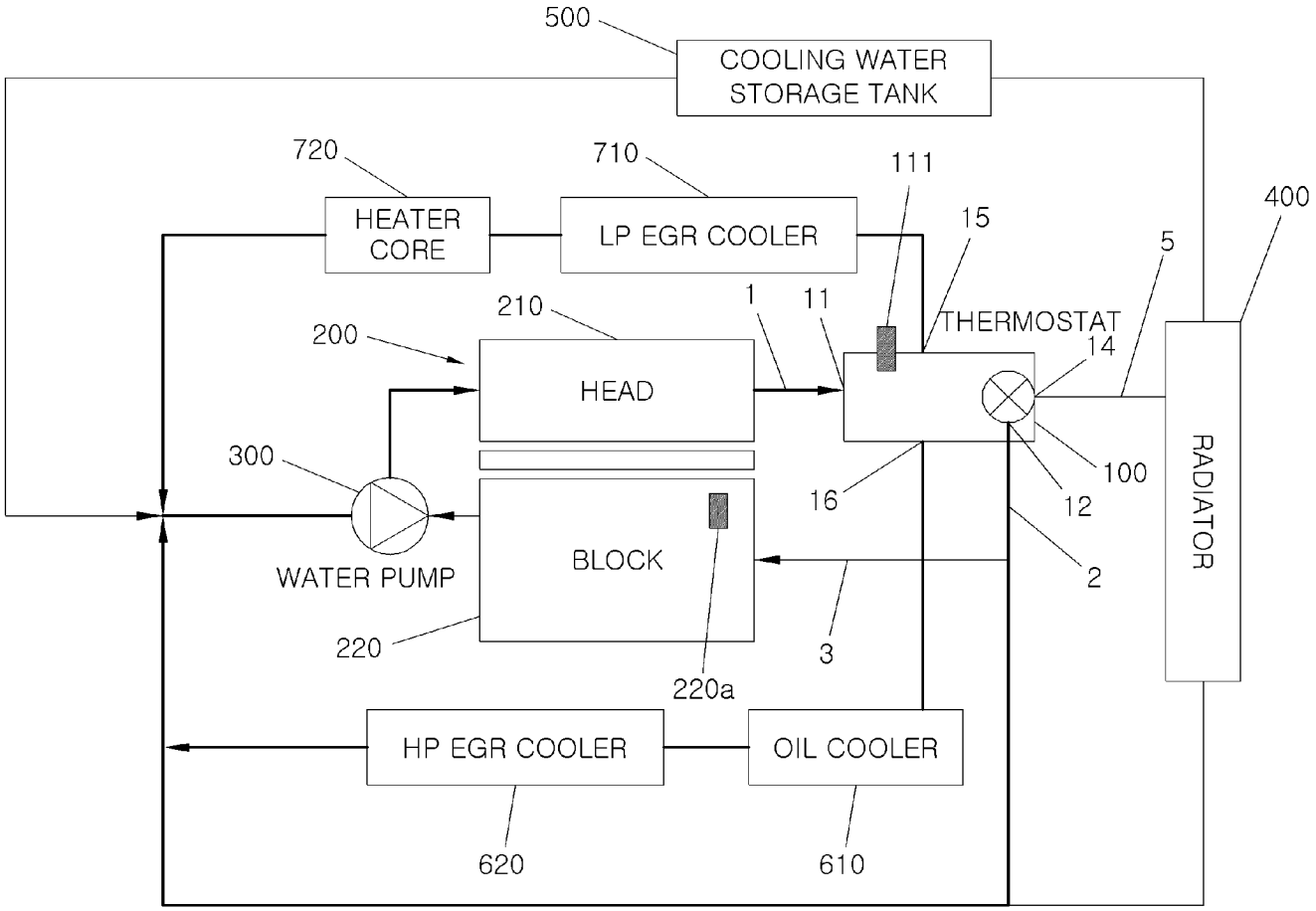

FIG. 4B is a diagram illustrating an example of the flow of the cooling water when the operating condition of the engine is changed from the cold condition to the warm condition. In this state, the temperature range of the cooling water is in the first temperature range. When the engine is in the warm state where the temperature of the cooling water is higher than that of FIG. 4A, the control unit 800 controls the drive heater 106 of the electronic thermostat 100 so that the electronic thermostat 100 is in the state of FIG. 3A. In other words, the fourth passage 5 toward the inlet of the radiator 400 is closed by the third valve 104, the first passage 2 toward the water pump 300 is opened by the first valve 102, and the second passage 3 toward the cylinder block 220 is closed by the second valve 103. In other words, the second passage 3 and the fourth passage 5 are closed, and the first passage 2 is opened. Therefore, the cooling water does not flow into the cylinder block 220 and the radiator 400. As a result, it is possible to reduce the friction when the engine 200 warms up, and to improve fuel efficiency.

Figure 4C:
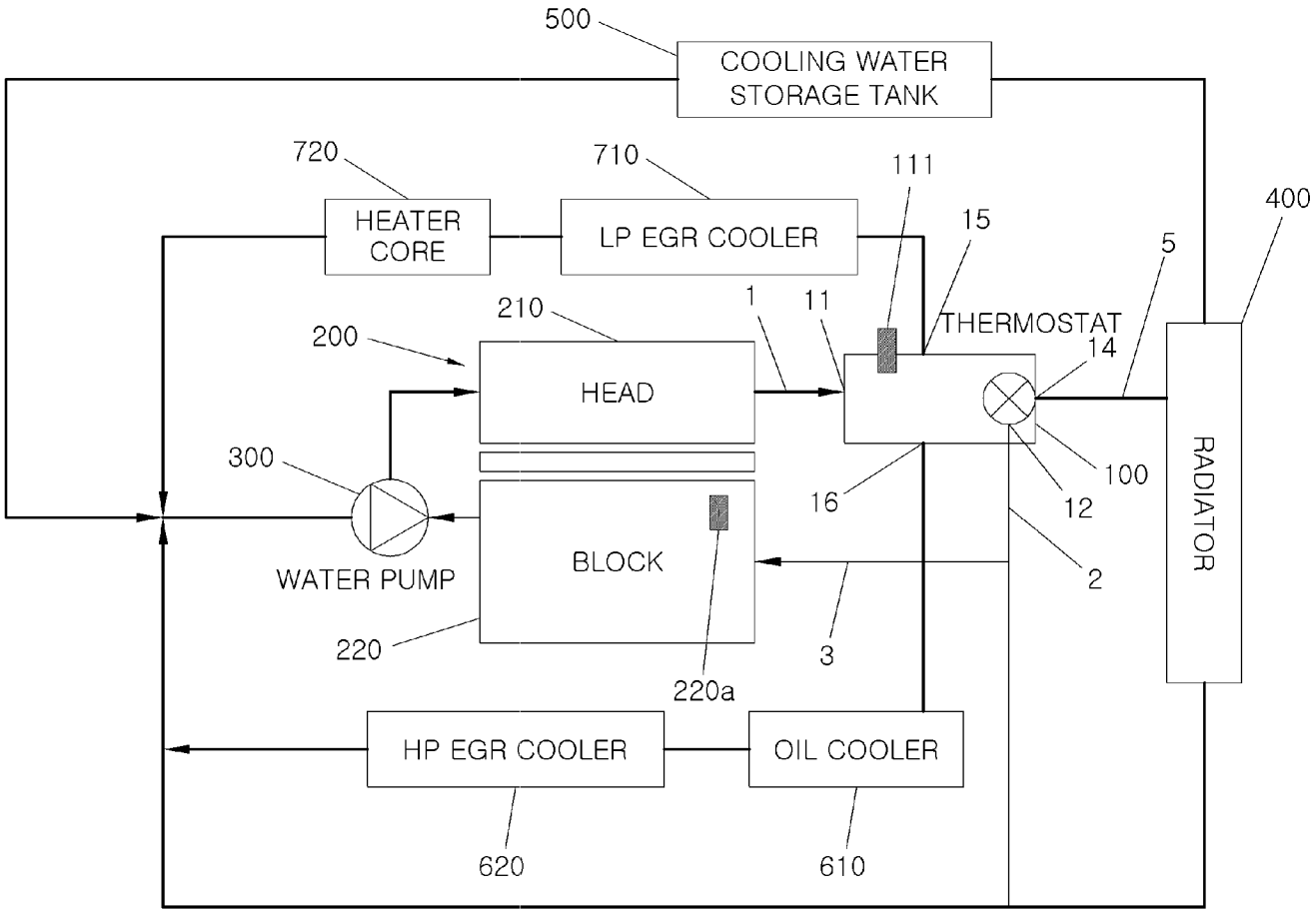

FIG. 4C is a diagram illustrating an example of the flow of the cooling water when the operating condition of the engine is changed from a warm condition to a hot condition. In this state, the temperature range of the cooling water is in a second temperature range (e.g., the temperature of the cooling water is 90° C. or more) higher than the first temperature range. When the engine is in the hot state where the temperature of the cooling water is higher than that of FIG. 4B, the control unit 800 controls the drive heater 106 of the electronic thermostat 100 so that the electronic thermostat 100 is in the state of FIG. 3B. The first passage 2 toward the water pump 300 and the second passage 3 toward the cylinder block 220 are closed, and the fourth passage 5 toward the radiator 400 is opened. Unlike in the state of FIG. 4B, the electronic thermostat 100 opens the third valve 104 to supply the overheated cooling water to the radiator 400 to cool the cooling water. In this embodiment, the opening temperature of the electronic thermostat 100 is set to be high in the low speed and in the low load conditions of the engine 200 and is set to be low in the high speed and high load conditions.

Figure 4D:
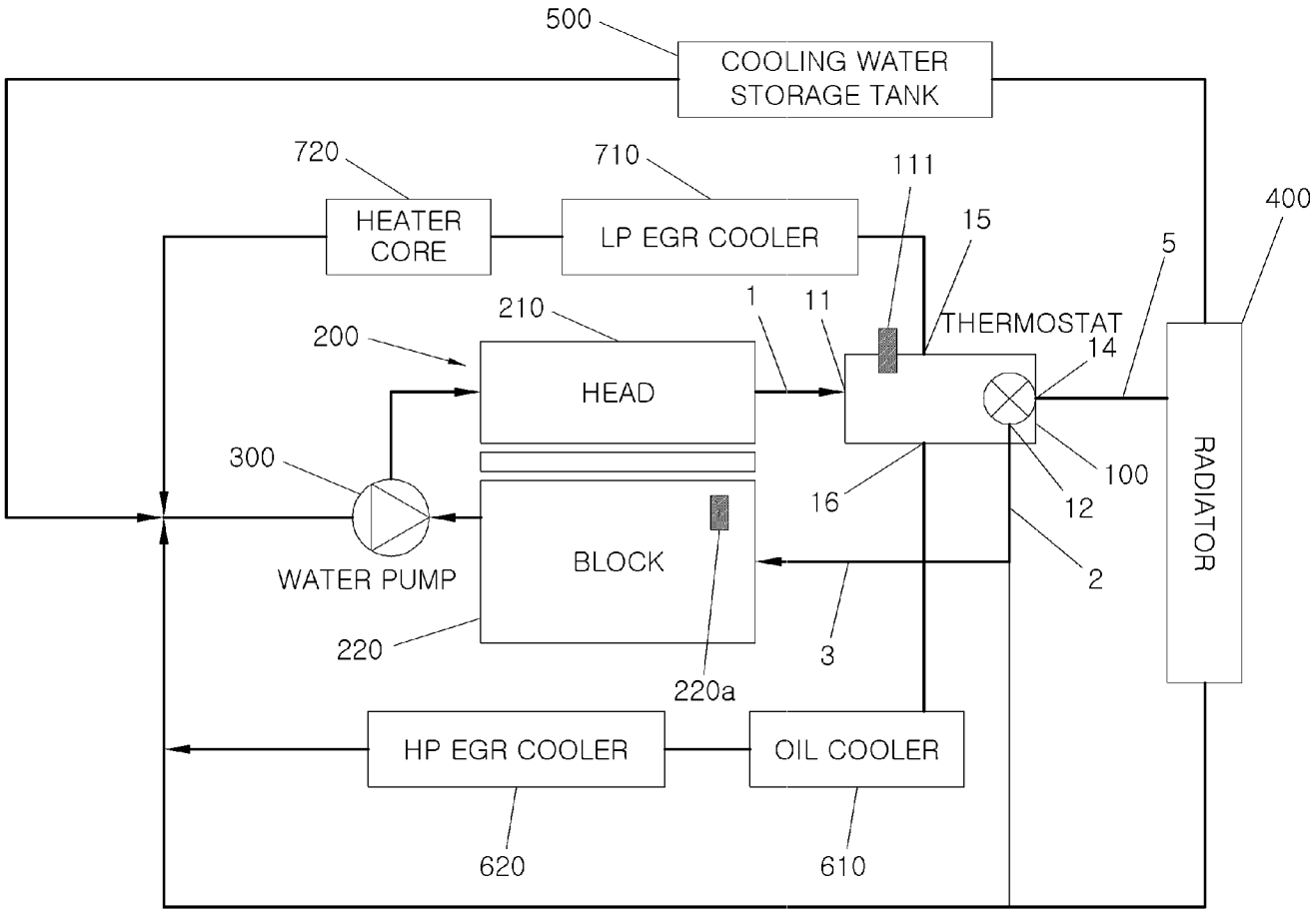

FIG. 4D is a diagram illustrating an example of the flow of the cooling water when the temperature of the cooling water is changed to the state exceeding the hot condition. In this state, the temperature range of the cooling water is in a third temperature range (e.g., the temperature of the cooling water is 105° C. or more) higher than the second temperature range. When the engine is in the overheated state where the temperature of the cooling water is higher than that of FIG. 4C, the control unit 800 controls the drive heater 106 of the electronic thermostat 100 so that the electronic thermostat 100 is in the state of FIG. 3C. In other words, the first passage 2 toward the water pump 300 is closed, and the second passage 3 toward the cylinder block 220 and the fourth passage 5 toward the radiator 400 are opened. It is necessary to rapidly cool the engine 200 by increasing the flow rate of the cooling water to the cylinder block 220 when the engine 200 is in the overheated state. Therefore, the drive heater 106 is controlled to open the second passage 3 toward the cylinder block 220. Then, the first passage 2, which is a bypass passage, is closed to quickly cool the amount of the cooling water flowing to the radiator 400 in order to rapidly cool the cooling water to quickly cool the engine 200.

As described above, in the engine cooling system according to the present disclosure, it is possible to appropriately control the flow rate of the cooling water to the radiator, the cylinder block, and the cylinder head according to the RPM of the engine, the engine load, the water temperature of the cooling water, and the like, thereby improving the fuel efficiency and the durability of the engine.

As described above, while the present disclosure has been described with reference to the embodiments illustrated in the drawings, the embodiments are only illustrative. It is to be understood by those of ordinary skill in the art that various modifications therefrom may be made, and all or part of the above-described embodiment(s) may also be configured to selectively combine them. Therefore, the true technical protection scope of the present disclosure should be determined by the technical spirit of the appended claims.

What is claimed is:

1. A cooling system of an engine, the cooling system comprising:

the engine;

a water pump for supplying cooling water to the engine;

an electronic thermostat into which the cooling water is flowed from a cylinder head of the engine through a first inlet, the electronic thermostat controlling the flow rate of the received cooling water supplied to the outside; and a control unit for controlling the electronic thermostat, wherein the electronic thermostat comprises a first valve for controlling the flow rate of the cooling water supplied to a first passage for connecting a first outlet of the electronic thermostat and a water pump, and a second valve for controlling the flow rate of the cooling water flowing through a second passage for connecting an outlet side of a radiator and an inlet side of a cylinder block of the engine from the outlet side of the radiator to the inlet side of the cylinder block, wherein the control unit controls the first valve, the second valve, and a third valve by controlling a drive heater of the electronic thermostat, and wherein the second valve integrally moves together according to a movement of the first valve.

2. The cooling system of claim 1, wherein the first passage is branched at a first branch point from a third passage connected from the outlet side of the radiator to the water pump to be connected to an inlet side of the thermostat.

3. The cooling system of claim 2, wherein the second passage is branched from the third passage at the point under the first branch point to be connected to the inlet side of the cylinder block of the engine.

4. The cooling system of claim 1, wherein the third valve is configured to control the flow rate of the cooling water supplied to a fourth passage for connecting a second outlet of the electronic thermostat and an inlet side of the radiator.

5. The cooling system of claim 4, comprising:

a thermostat case in which the first inlet, the first outlet, and the second outlet are formed;

a valve body provided inside the thermostat case; and a thermosensitive member filled inside the valve body, and shrinking or expanding according to a temperature, wherein the first valve is formed at a first outlet side of the valve body, wherein the third valve is formed at a second outlet side of the valve body, wherein the second valve is integrally formed to be spaced at a predetermined interval apart from the first valve at one side of the first valve, and wherein the drive heater is configured to apply heat to the thermosensitive member in order to drive the first valve, the second valve, and the third valve.

6. The cooling system of claim 5, wherein the thermostat case is formed with a third outlet connected to an inlet of a low pressure exhaust gas recirculation (EGR) valve or a heater core.

7. The cooling system of claim 5, wherein the thermostat case is formed with a fourth outlet connected to an inlet of a high pressure EGR valve or an oil cooler.

8. The cooling system of claim 5, wherein the control unit controls the drive heater so that when the temperature of the cooling water is in a first temperature range, the first valve is opened, and at this time, the second valve is closed and the third valve is closed.

9. The cooling system of claim 8, wherein the control unit controls the drive heater so that when the temperature of the cooling water is in a second temperature range higher than the first temperature range, the first valve is closed, and at this time, the second valve is also closed and the third valve is opened.

10. The cooling system of claim 9, wherein the control unit controls the drive heater so that when the temperature of the cooling water is in a third temperature range higher than the second temperature range, the first valve is closed, and at this time, the second valve is opened and the third valve is opened.

11. The cooling system of claim 8, wherein the control unit stops the flow of the cooling water in the engine system by stopping an operation of the water pump, when the temperature of the cooling water is lower than the first temperature range.

12. A cooling system of an engine, the cooling system comprising:

the engine;

a water pump for supplying cooling water to the engine;

an electronic thermostat into which the cooling water is flowed from a cylinder head of the engine through a first inlet, the electronic thermostat controlling the flow rate of the received cooling water supplied to the outside; and a control unit for controlling the electronic thermostat, wherein the electronic thermostat includes a first valve for controlling the flow rate of the cooling water supplied to a first passage for connecting a first outlet of the electronic thermostat and a water pump, and a second valve for controlling the flow rate of the cooling water flowing through a second passage for connecting an outlet side of a radiator and an inlet side of a cylinder block of the engine from the outlet side of the radiator to the inlet side of the cylinder block, wherein the control unit controls the first valve, the second valve, and a third valve by controlling a drive heater of the electronic thermostat, and wherein the first passage is branched at a first branch point from a third passage connected from the outlet side of the radiator to the water pump to be connected to an inlet side of the thermostat.

13. The cooling system of claim 12, wherein the second passage is branched from the third passage at the point under the first branch point to be connected to the inlet side of the cylinder block of the engine.

14. A cooling system of an engine, the cooling system comprising:

the engine;

a water pump for supplying cooling water to the engine;

an electronic thermostat into which the cooling water is flowed from a cylinder head of the engine through a first inlet, the electronic thermostat controlling the flow rate of the received cooling water supplied to the outside; and a control unit for controlling the electronic thermostat, wherein the electronic thermostat includes a first valve for controlling the flow rate of the cooling water supplied to a first passage for connecting a first outlet of the electronic thermostat and a water pump, and a second valve for controlling the flow rate of the cooling water flowing through a second passage for connecting an outlet side of a radiator and an inlet side of a cylinder block of the engine from the outlet side of the radiator to the inlet side of the cylinder block, wherein the control unit controls the first valve, the second valve, and a third valve by controlling a drive heater of the electronic thermostat, and wherein the third valve is configured to control the flow rate of the cooling water supplied to a fourth passage for connecting a second outlet of the electronic thermostat and an inlet side of the radiator.

15. The cooling system of claim 14, comprising:

a thermostat case in which the first inlet, the first outlet, and the second outlet are formed;

a valve body provided inside the thermostat case; and a thermosensitive member filled inside the valve body, and shrinking or expanding according to a temperature, wherein the first valve is formed at a first outlet side of the valve body, wherein the third valve is formed at a second outlet side of the valve body, wherein the second valve is integrally formed to be spaced at a predetermined interval apart from the first valve at one side of the first valve, and wherein the drive heater is configured to apply heat to the thermosensitive member in order to drive the first valve, the second valve, and the third valve.

16. The cooling system of claim 15, wherein the thermostat case is formed with a third outlet connected to an inlet of a low pressure exhaust gas recirculation (EGR) valve or a heater core.

17. The cooling system of claim 15, wherein the thermostat case is formed with a fourth outlet connected to an inlet of a high pressure EGR valve or an oil cooler.

18. The cooling system of claim 15, wherein the control unit controls the drive heater so that, when the temperature of the cooling water is in a first temperature range, the first valve is opened, and at this time, the second valve is closed and the third valve is closed.

19. The cooling system of claim 18, wherein the control unit controls the drive heater so that, when the temperature of the cooling water is in a second temperature range higher than the first temperature range, the first valve is closed, and at this time, the second valve is also closed and the third valve is opened.

20. The cooling system of claim 19, wherein the control unit controls the drive heater so that, when the temperature of the cooling water is in a third temperature range higher than the second temperature range, the first valve is closed, and at this time, the second valve is opened and the third valve is opened.

* * * * *